US006015048A

United States Patent [19]

Mitsumura et al.

[11] Patent Number: 6,015,048

[45] **Date of Patent: *Jan. 18, 2000**

[54] GAS CURRENT CLASSIFIER AND PROCESS FOR PRODUCING TONER

[76] Inventors: Satoshi Mitsumura; Yoshinori Tsuji, both of c/o Canon Kabushiki Kaisha 30-2, 3-chome, Shimomaruko, Ohta-ku, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/531,061

[22] Filed: Sep. 20, 1995

[30] Foreign Application Priority Data

| | | | |
|---|---|---|---|
| Sep. 21, 1994 | [JP] | Japan | 6-251575 |
| Dec. 28, 1994 | [JP] | Japan | 6-337581 |
| Dec. 28, 1994 | [JP] | Japan | 6-337620 |

[51] Int. Cl.[7] ..... B07B 4/00; B07B 7/04

[52] U.S. Cl. ..... 209/143; 209/139.1

[58] Field of Search ..... 209/134, 135, 209/136, 137, 138, 139.1, 143

[56] References Cited

U.S. PATENT DOCUMENTS

| | | | |
|---|---|---|---|
| 1,660,682 | 2/1928 | Stebbins | 209/138 |
| 2,026,910 | 1/1936 | Olsen | 209/137 |
| 3,520,407 | 7/1970 | Rumpf et al. | 209/139 |
| 4,132,634 | 1/1979 | Rumpf et al. | 209/138 X |
| 4,153,541 | 5/1979 | Rumpf et al. | 209/143 |
| 4,782,001 | 11/1988 | Kanda et al. | 209/135 X |
| 4,802,977 | 2/1989 | Kanda et al. | 209/143 |
| 4,844,349 | 7/1989 | Kanda et al. | 241/19 |
| 5,073,252 | 12/1991 | Ouig | 209/143 |
| 5,111,998 | 5/1992 | Kanda et al. | 241/5 |
| 5,447,275 | 9/1995 | Goka et al. | 241/5 |
| 5,712,075 | 1/1998 | Mitsumura et al. | 209/143 X |

FOREIGN PATENT DOCUMENTS

| | | | |
|---|---|---|---|
| 0246074 | 11/1987 | European Pat. Off. . | |
| 4339532 | 8/1994 | Germany . | |
| 2-288451 | 6/1992 | Japan | 209/139.1 |
| 8202809 | 2/1984 | Netherlands . | |
| 87/290872 | 3/1987 | U.S.S.R. | 209/139.1 |

OTHER PUBLICATIONS

Okuda, et al, "Application of Fluidics . . . Classification," Int'l Symposium on Powder Techn. (1981) pp. 771–781.

*Primary Examiner*—Donald P. Walsh
*Assistant Examiner*—Daniel K Schlak
*Attorney, Agent, or Firm*—Fitzpatrick, Cella, Harper & Scinto

[57] ABSTRACT

A gas current classifier which comprises a classifying chamber, a material feed nozzle for introducing a material powder into the classification zone of the classifying chamber, and a Coanda block for classifying the material powder thus introduced by the Coanda effect to separate the powder into at least a fraction of fine powder and a fraction of coarse powder, wherein the material feed nozzle has a material receiving opening for introducing the material powder into the material feed nozzle the material powder is introduced into the classification zone from an orifice of the material feed nozzle while its flow is accelerated by the gas stream within the material feed nozzle and the Coanda block is provided at a position higher than the orifice of the material feed nozzle.

15 Claims, 12 Drawing Sheets

GAS CURRENT CLASSIFIER AND PROCESS FOR PRODUCING TONER

BACKGROUND OF THE INVENTION

1. Field of the Invention

This invention relates to a gas current classifier (an air classifier) for classifying powder utilizing the Coanda effect. More particularly, the present invention relates to a gas current classifier for classifying powder to obtain particles having a given particle size utilizing the Coanda effect and the differences in inertia force and centrifugal force according to the particle size of each particle of the powder while the powder is carried on gas streams, so that a powder in which particles of 20 $\mu$m or smaller diameter are 50% by number or more can be obtained efficiently.

This invention also relates to a process for producing a toner by means of a gas current classifier for classifying a colored resin powder utilizing the Coanda effect. More particularly, the present invention relates to a process for producing a toner for developing electrostatic images, by classifying colored resin powder to collect particles having a given particle size based on the Coanda effect and the differences in inertia force and centrifugal force according to the particle size of each particle of the powder while the powder is carried on a gas stream, so that a colored resin powder in which particles of 20 $\mu$m or smaller diameter are 50% by number or more can be obtained efficiently.

2. Related Background Art

For powder classification, various gas current classifiers have been proposed. There are classifiers having rotating blades and those having no moving parts. The classifiers having no moving parts include fixed-wall centrifugal classifiers and inertial classifiers. In classifiers utilizing inertia force, Elbow Jet classifier disclosed in Loffier, F. and K. Maly, Symposium on Powder Technology D2 (1981) and commercially available from Nittetsu Kogyo, and a classifier disclosed in Okuda, S. and Yasukuni, J., Proceedings of International Symposium on Powder Technology '81, 771 (1981) were contrived as an inertial classifier which can carry out classification in a fine-powder range.

In such a gas current classifier, as shown in FIGS. 9 and 10, the material powder is jetted into the classification zone of a classifying chamber 32 at a high speed with a gas stream, from a material feeding nozzle 16 having an orifice to the classification zone. A gas stream is introduced in the classifying chamber to cross the gas stream emitted from the material feed nozzle 16 so that by the action of centrifugal force produced by the curved gas stream along the Coanda block 26 provided in the chamber the powder is classified into three fractions of coarse powder, medium powder and fine powder and separated by means of classifying edges 117 and 118 each having a tapered tip.

In such a conventional classifier 101, however, as shown in FIG. 12, the material powder fed from a material receiving opening 40 into the material feed nozzle 16, flows in the material feed nozzle 16, showing a tendency to flow along the wall of the nozzle. Here, in the material feed nozzle 16, the material powder fed downward tends to be gravity-classified, so that light fine powder tends to be enriched in the upper stream of the path and heavy coarse powder in the lower stream in the path. Thus, as shown in FIG. 13, the coarse particles in the lower stream disturb the movement of the fine particles in the upper stream, and there has been a limit in the improvement of classification precision. Moreover, with a powder containing coarse particles with particle diameters of 20 $\mu$m or larger much, the precision tends to decrease.

Especially when the classification of the material powder is carried out in the production process of a toner to be used in image forming apparatus such as copying machines and electrophotographic printers, the classified fractions of particles are required to have sharp particle size distributions, and it is also important that the cost of the classification is low and the efficiency is high as well as classification precision.

From such points of view, required is a gas current classifier that can stably and efficiently classify powder, in particular, colored fine resin powder such as a toner in a good precision.

SUMMARY OF THE INVENTION

An object of the present invention is to provide a gas current classifier that has solved the problems discussed above, and a process for producing a toner.

Another object of the present invention is to provide a gas current classifier which can classify powder in high precision and can efficiently produce powders having precise particle size distributions, and a process for producing a toner utilizing it.

Still another object of the present invention is to provide a gas current classifier that may hardly cause melt-adhesion of particles in the classification zone, may cause no variation of classification points in the classifier, and can carry out stable classification.

A further object of the present invention is to provide a gas current classifier that enables wide alteration of classification points.

A still further object of the present invention is to provide a gas current classifier that enables alteration of classification points in a short time.

A still further object of the present invention is to provide a process for producing a toner, that enables classification in a high precision because of accurate setting of classification points, and can efficiently produce powders having precise particle size distributions.

A still further object of the present invention is to provide a process for producing a toner, that may hardly cause melt-adhesion of particles, may cause no variations of classification points in the classifier, and can carry out stable classification.

A still further object of the present invention is to provide a process for producing a toner, that enables the wide alteration of classification points.

A still further object of the present invention is to provide a process for producing a toner, that enables the alteration of classification points in a short time.

The present invention provides a gas current classifier comprising a classifying chamber, a material feed nozzle for introducing the material powder into the classification zone of the classifying chamber, and a Coanda block for classifying the material powder thus introduced due to the Coanda effect into at least two fractions of fine powder and coarse powder, wherein;

the material feed nozzle has a material receiving opening for introducing the material powder into the material feed nozzle; the material powder being introduced into the classification zone through an orifice of the material feed nozzle with a high speed accelerated by the gas stream flowing within the material feed nozzle; and the Coanda block is provided at a position higher than the position of the orifice of the material feed nozzle.

The present invention also provides a process for producing a toner, comprising the steps of;

introducing a colored resin powder into a gas current classifier and classifying the colored resin powder into at least three fractions of fine, medium and course powder; and producing the toner from the fraction of medium powder thus separated;

wherein;

the gas current classifier has at least a classifying chamber, a material feed nozzle for introducing the colored resin powder into the classification zone of the classifying chamber, and a Coanda block for classifying the colored resin powder thus introduced due to the Coanda effect into at least three fractions of fine, medium and coarse powder;

the material feed nozzle having a material receiving opening for introducing the colored resin powder into the material feed nozzle; the colored resin powder being introduced into the classification zone through an orifice of the material feed nozzle while its speed is accelerated by the gas stream within the material feed nozzle; and the Coanda block being provided at a position higher the orifice of the material feed nozzle.

DESCRIPTION OF THE PREFERRED EMBODIMENTS

Preferred embodiments of the present invention will be explained below with reference to the accompanying drawings to describe the present invention in detail.

Figure 1:
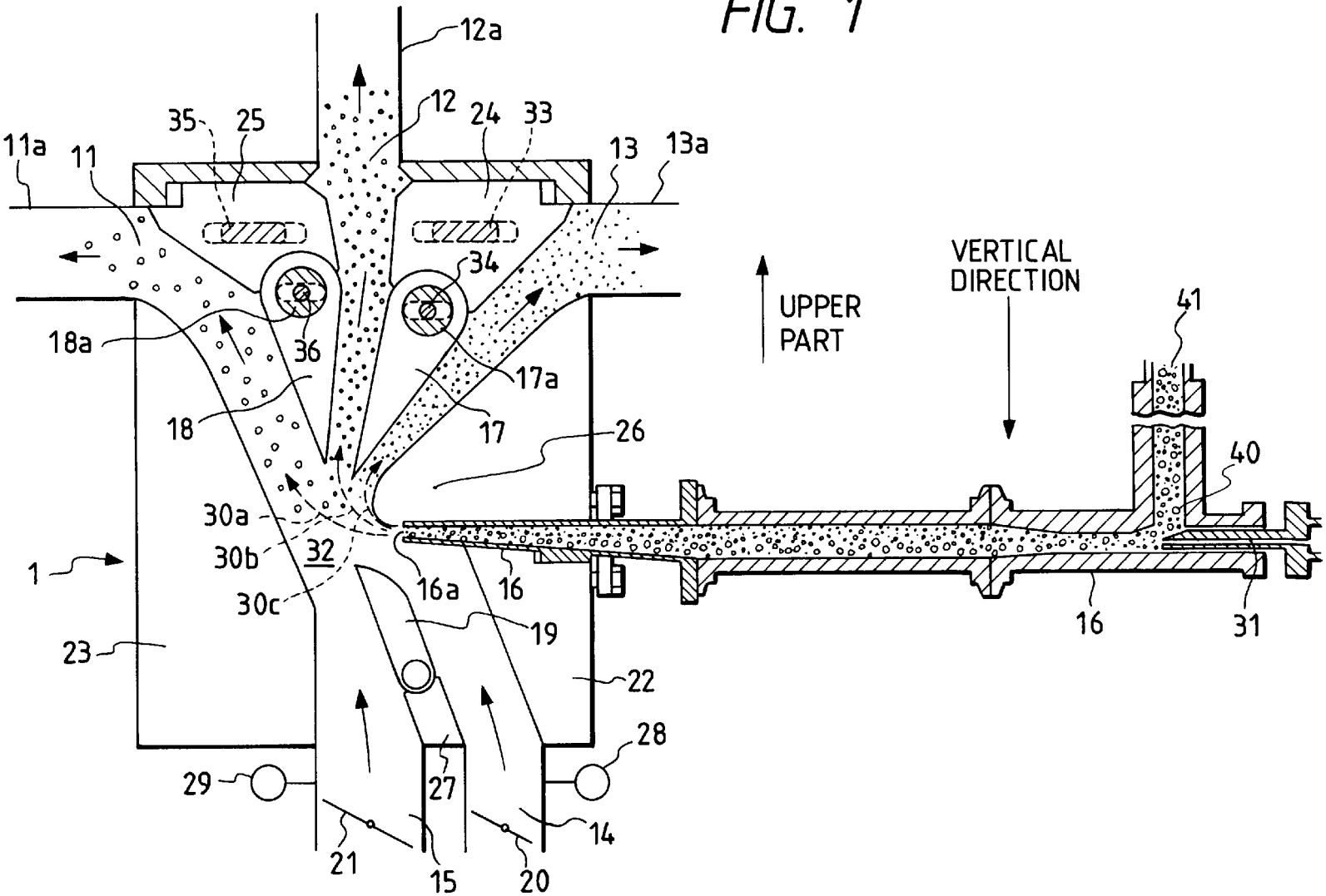
FIG. 1 is a schematic cross section of a gas current classifier of the present invention.
Figure 2:
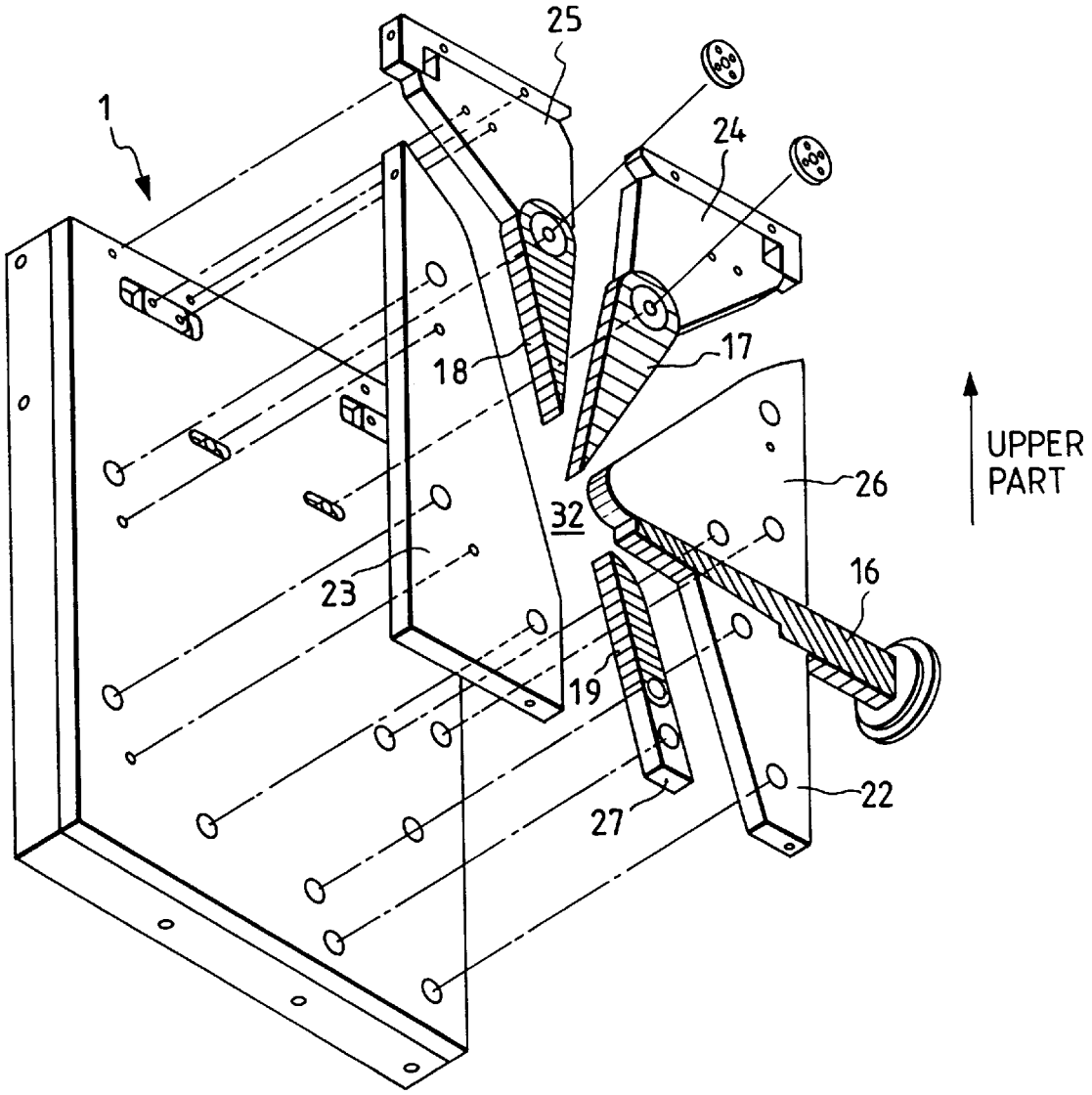
FIG. 2 is an exploded perspective view of the gas current classifier shown in FIG. 1.

An embodiment of the gas current apparatus used in the present invention is exemplified by an apparatus as shown in FIG. 1 (a sectional view) and FIG. 2 (an exploded perspective view).

Figure 11:
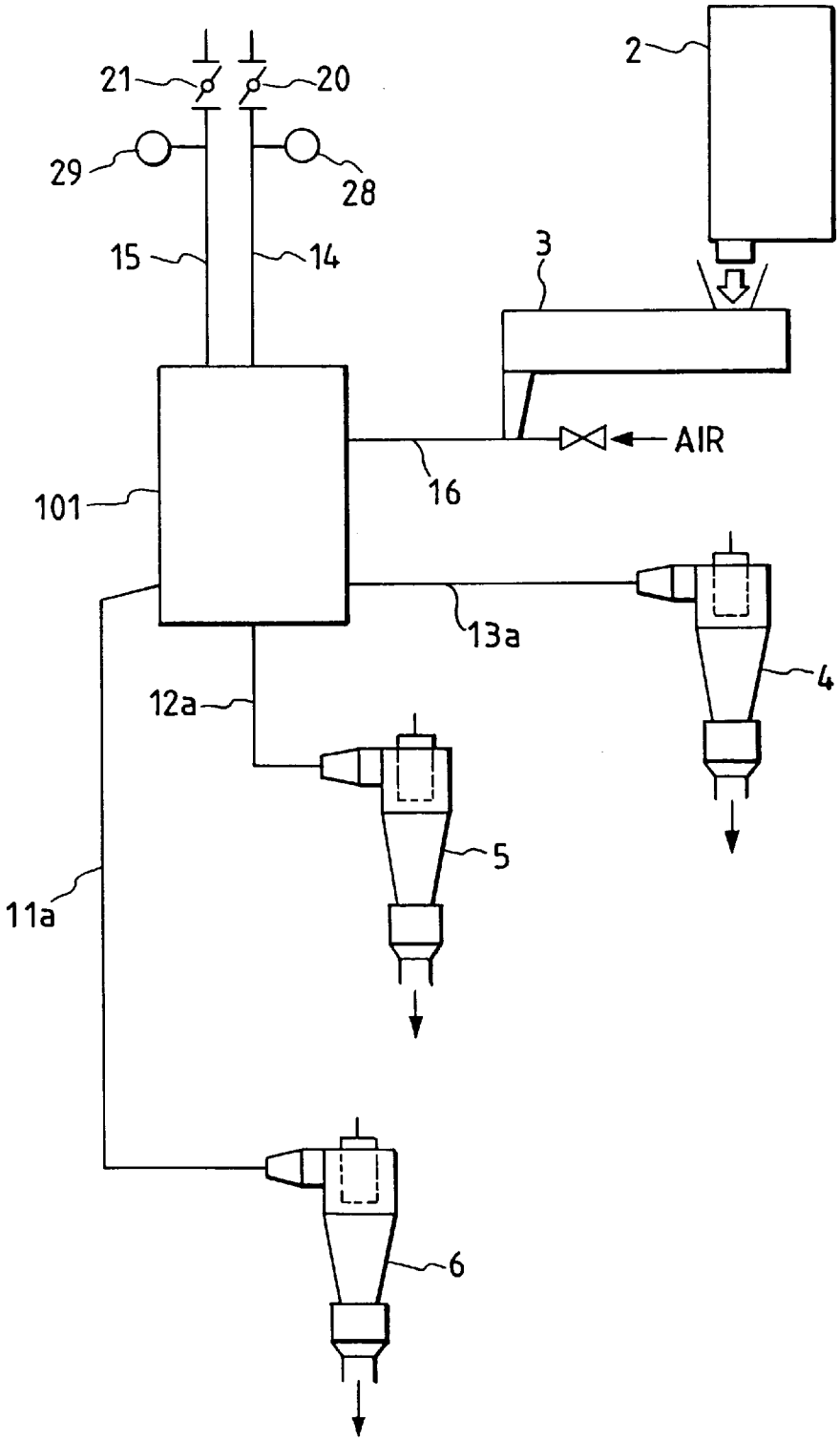
FIG. 11 PRIOR ART
FIG. 11 illustrates an example of a conventional classification process.
Figure 12:
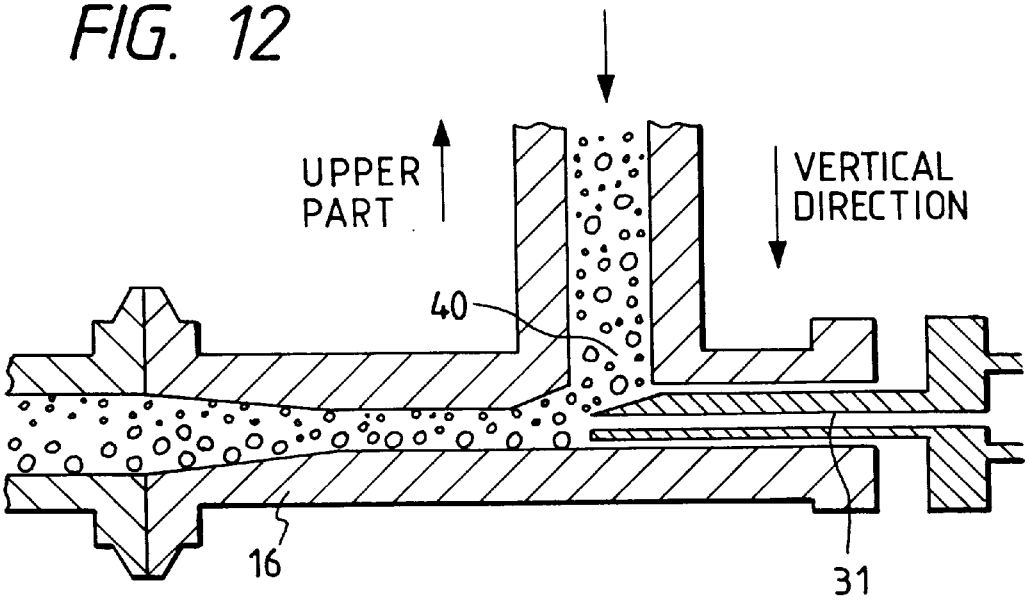
FIG. 12 is an enlarged cross sectional view of the material receiving opening of the material feed nozzle.
Figure 13:
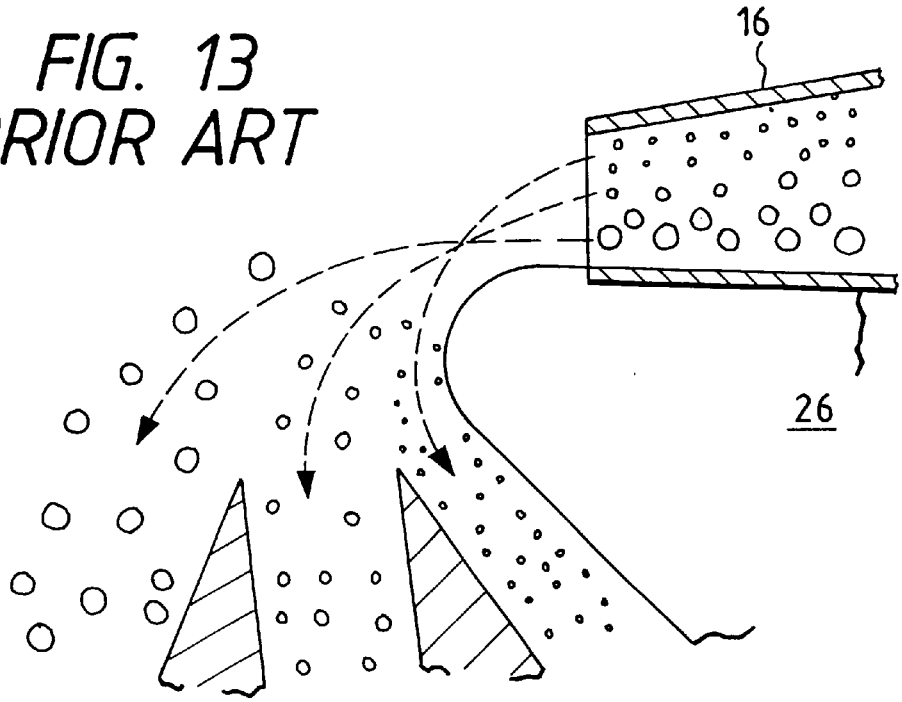
FIG. 13 PRIOR ART
FIG. 13 is an enlarged cross sectional view of the orifice of the material feed nozzle, and the vicinity thereof, in the conventional gas current classifier.

In the gas current classifier of the present invention, a material powder 41 is fed from the material receiving opening 40 provided at a higher position than that of a material feed nozzle 16, whereupon gravity classification takes place within the material feed nozzle 16 due to the Coanda effect. A fraction of fine powder forms an upper stream and a fraction of coarse powder forms a lower stream. Since a Coanda block 26 is provided above the orifice provided at the end of the material feed nozzle 16 in the classifying chamber, the flows of these upper stream and lower stream are not disturbed, and the flow of coarse powder (the lower stream) can be classified in outer circumference and the flow of fine powder (the upper stream) in inner circumference, by the Coanda effect. Hence, the classification zone is larger than that of the conventional gas current classifier as shown in FIG. 11 and the classification points can be widely altered. At the same time, the classification points can be adjusted precisely without disturbing the gas stream around the tips of classifying edges. As a result, according to the present invention, the melt-adhesion of particles to the tips of classifying edges can be satisfactorily prevented. Also, the disturbance of classifying gas stream at the tips of classifying edges can be well prevented, accurate classification points can be obtained in accordance with various specific gravity of the powder and conditions of classification gas stream, and the classification points do not deviate even when the classifier is continuously operated, so that the classification efficiency is improved. The present invention is effective especially when a fine powder with particle diameter of 10 $\mu$m or smaller is classified.

As shown in FIGS. 1 and 2, side walls 22 and 23 form part of the classifying chamber, and classifying edge blocks 24 and 25 are provided with classifying edges 17 and 18, respectively. The classifying edges 17 and 18 are rotatable around shafts 17*a* and 18*a*, respectively, and thus the tip position of each classifying edge can be changed by rotating the classifying edge. The respective classifying edge blocks 24 and 25 are set up so that they can slide right and left. As they are slid, the knife-edge type classifying edges 17 and 18 are also slid right and left. These classifying edges 17 and 18 divide the classification zone of the classifying chamber 32 into three partitions.

A material feed nozzle 16 having at its upper part a material receiving opening 40 for introducing a material powder 41 and having an orifice opening in the classifying chamber 32 is set at the upper part of the side wall 22, and a Coanda block 26 is disposed at a position higher than the material feed nozzle 16 and a part of the edge of the Coanda block 26 is a curve synthesized from circular arcs that curves upward from the tangential extension of the upper line of the material feed nozzle 16. At the lower part of the classifying chamber 32, provided are a lower block 27 provided with a knife edge-shaped gas-intake edge 19 and gas-intake pipes 14 and 15 opening into the classifying chamber 32. The gas-intake pipes 14 and 15 are respectively provided with a first gas feed control means 20 and a second gas feed control means 21 such as a damper, respectively, and also provided with static pressure gauges 28 and 29.

The locations of the classifying edges 17 and 18 and the gas-intake edge 19 are adjusted according to the kind of the material powder to be classified, and also according to the desired particle size.

At the upper part of the classifying chamber 32, discharge ports 11, 12 and 13 opening to the classifying chamber are provided correspondingly to the respective classification zones. The discharge ports 11, 12 and 13 are connected with communicating means such as pipes, and may be respectively provided with shutter means such as valve means.

The material feed nozzle 16 comprises a square pipe section and a tapered square pipe section, and the ratio of the inner height of the square pipe section to that of the narrowest part of the tapered square pipe section may be set at from 20:1 to 1:1, and preferably from 10:1 to 2:1, to obtain a good feed speed.

The material feed nozzle 16 is, at its rear end, provided with an injection nozzle 31 through which the gas for transporting the material powder is fed.

The classification in the multi-zone classifying area having the above construction is operated, for example, in the following way. The inside of the classifying chamber is evacuated through at least one of the discharge ports 11, 12 and 13. The material powder is jetted into the classifying chamber 32 through the material feed nozzle 16 opening into the classifying chamber 32 at a speed of preferably from 50 m/sec to 300 m/sec, with the gas stream flowing at a high speed in the material feed nozzle 16.

The particles in the material powder fed into the classifying chamber are driven drawing curves 30*a*, 30*b* and 30*c* by the Coanda effect of the Coanda block 26 and the action of the gas (e.g. air) concurrently flowed in, to be classified according to the particle size and inertia force of the individual particles in such a way that course powder (a fraction of larger particles) is classified to the first zone along outer gas stream, i.e., to the outside of the classifying edge 18, medium powder (a fraction of medium particles) is classified to the second zone defined between the classifying edges 18 and 17, and fine powder (a fraction of smaller particles) is classified to the third zone, inside of the classifying edge 17. The larger particles, the medium particles and the smaller particles separated by classification are discharged from the discharge ports 11, 12 and 13, respectively.

In the classification of material powder according to the present embodiment, the classification points chiefly depend on the tip positions of the classifying edges 17 and 18 with respect to the left end of the Coanda block 26 where the material powder is jetted out into the classifying chamber 32. The classification points are also affected by the flow rate of classification gas stream or the speed of the powder jetted out of the material feed nozzle 16.

In the gas current classifier of the present invention, the material powder 41 is instantaneously introduced into the classifying chamber from the material feed nozzle 16, classified there and then discharged outside the system of the classifier. It is important for the material powder introduced into the classifying chamber, to fly with a driving force without disturbing loci of individual particles from the orifice where the powder is introduced from the material feed nozzle 16 into the classifying chamber. The particles flowing in the path of the material feed nozzle 16 form the upper stream and the lower stream. When the material powder 41 is introduced from above (the material receiving opening 40 in FIG. 1), the upper stream contains light fine powder in a larger quantity and the lower stream heavy coarse powder in a larger quantity. Hence, upon the introduction of the flow of powder into the classifying chamber 32 provided with the Coanda block 26 above the orifice of the material feed nozzle 16, the powder is dispersed according to the size of particles to form particle streams, without disturbing the flying loci of particles. Thus, the classifying edges are shifted in the direction along the streamlines and then the tip positions of the classifying edges are fixed so as to set the given classification points. When these classifying edges 17 and 18 are shifted, concurrent shift of the classifying edge blocks 24 and 25 enables adjustment of the directions of the classifying edges along the directions of streams of the particles flying along the Coanda block 26.

Figure 3:
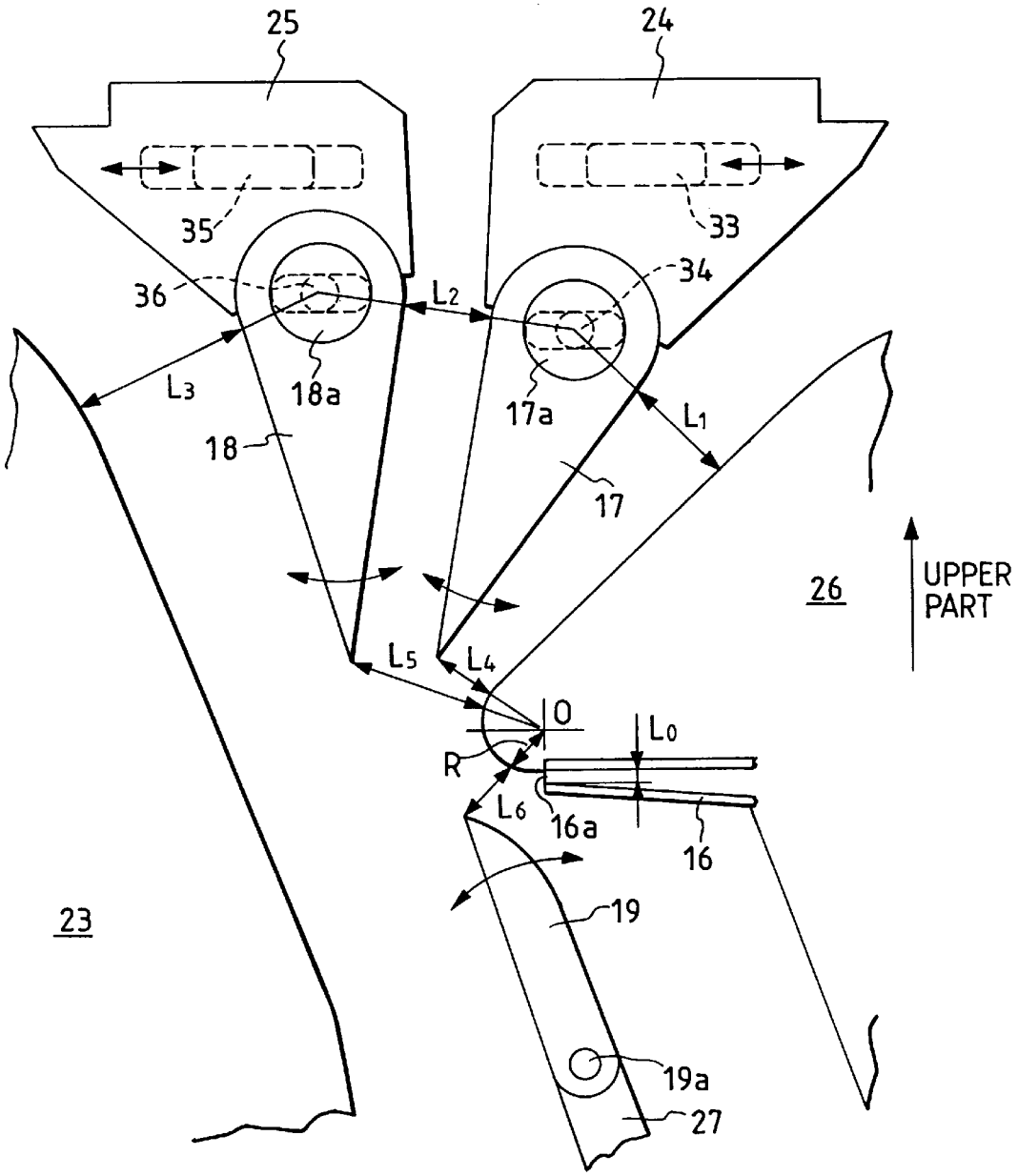
FIG. 3 illustrates the main part in FIG. 1.

Stated specifically, in FIG. 3, a distance $L_4$ between the tip of the classifying edge 17 and the wall surface of the Coanda block 26 which is determined by assuming a position O as the central point in the Coanda block 26 located above the orifice 16*a* of the material feed nozzle 16, and a distance $L_1$ between the side of the classifying edge 17 and the wall surface of the Coanda block 26, can be adjusted by shifting the classifying edge block 24 along the locating member 33 right and left so that the classifying edge 17 is shifted right and left along the locating member 34, and also by rotating the tip of the classifying edge 17 around the shaft 17*a*. Position O is defined as a point of intersection of the line drawn from the topmost point of the Coanda block 26 parallel to the top side of the orifice of the material feed nozzle 16 and a line perpendicular to it drawn from the end of the material feed nozzle 16.

Similarly, a distance $L_5$ between the tip of the classifying edge 18 and the wall surface of the Coanda block 26 and a distance $L_2$ between the side of the classifying edge 17 and the side of the classifying edge 18 or a distance $L_3$ between the side of the classifying edge 18 and the surface of the side wall 23 as shown in FIG. 3, can be adjusted by shifting the classifying edge block 25 along the locating member 35 right and left so that the classifying edge 18 is shifted right and left along the locating member 36, and also by rotating the tip of the classifying edge 18 around the shaft 18*a*. The Coanda block 26 and the classifying edges 17 and 18 are provided at positions higher than the orifice 16*a* of the material feed nozzle 16, and the shape of the classification zone in the classifying chamber changes as the set-up locations of the classifying edge block 24 and/or the classifying edge block 25 are altered. Thus, the classification points can be adjusted with ease and within a wide range.

Hence, the disturbance of streams by the tips of the classifying edges can be prevented, and the flying speed of particles can be increased to improve the dispersion of material powder in the classification zone, by controlling the flow of the suction stream produced by evacuating through the discharge pipes 11*a*, 12*a* and 13*a*. Thus, even with a higher concentration of the material powder, a good classification precision and the yield of the aimed particle fraction can be maintained, and a better classification precision and an improvement in the yield of products can be achieved compared with the same powder concentration.

A distance $L_6$ between the tip of the gas-intake edge 19 and the edge surface of the Coanda block 26 can be adjusted by rotating the tip of the gas-intake edge 19 around the shaft 19*a*. Thus, the classification points can be further adjusted by controlling the flow and flow speed of the air or gas blown in from the intake pipes 14 and 15.

The set-up distances described above are appropriately determined according to the properties of material powders. When a material powder has a true density of from 0.3 to 1.4 g/cm$^3$, the location preferably satisfy the condition of:

$$L_0<L_1+L_2<nL_3$$

($L_0$ is the height of the orifice 16*a* of the material feed nozzle; and n is a real number of 1 or more) and when a material powder has a true density more than 1.4 g/cm$^3$;

$$L_0<L_3<L_1+L_2.$$

When this condition is satisfied, products (medium powder) having a sharp particle size distribution can be obtained in a good efficiency.

Figure 4:
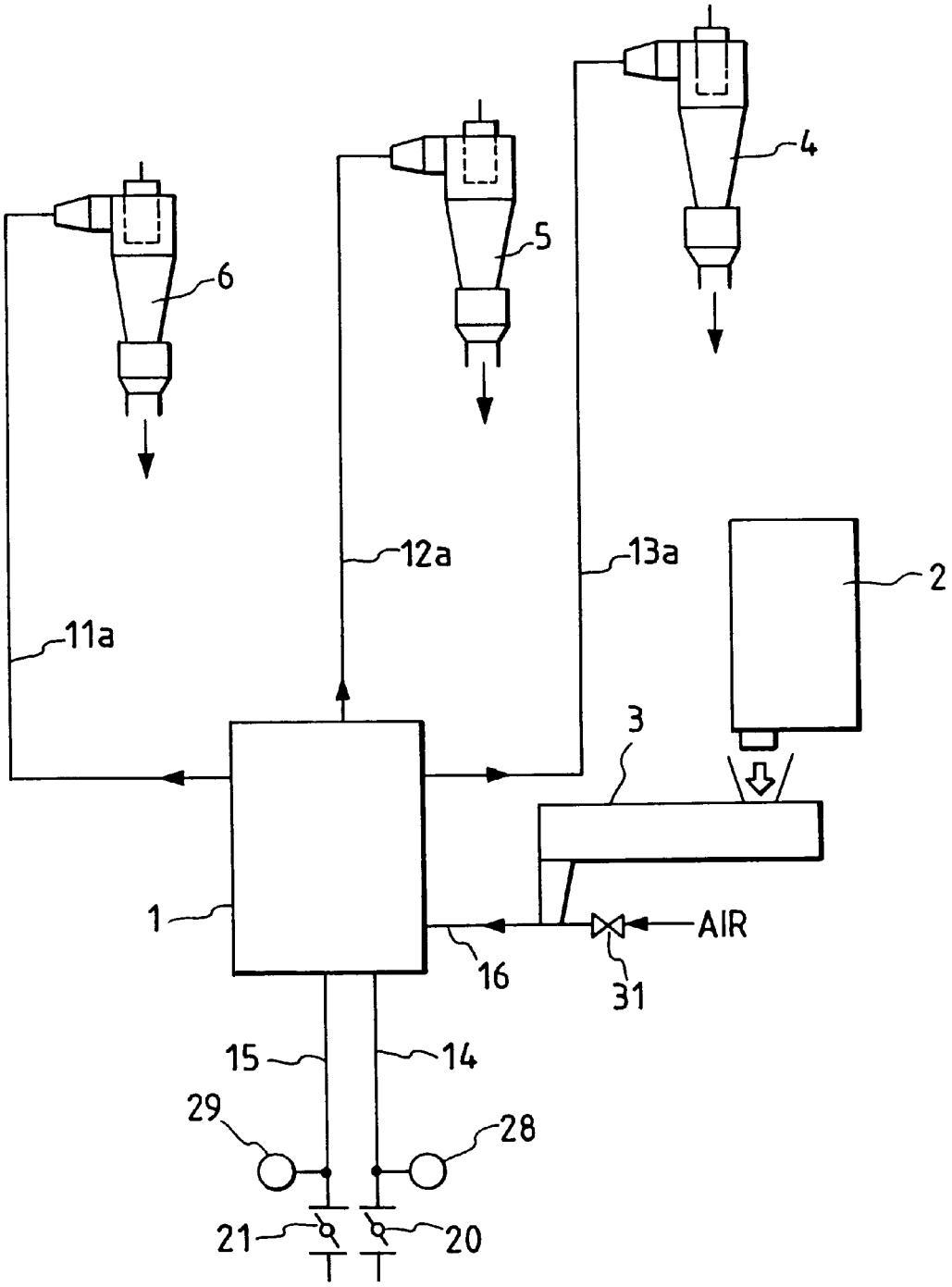
FIG. 4 illustrates an example of a classification process according to the present invention.

The gas current classifier of the present invention is usually used as a component unit of an apparatus system in which correlated components are connected through communicating means such as pipes. A preferred example of such a system is shown in FIG. 4. In the system as illustrated in FIG. 4, a tripartition classifier 1 (the classifier as illustrated in FIGS. 1 and 2), a quantitative feeder 2, a vibrating feeder 3, a collecting cyclones 4, 5 and 6 are all connected through communication means.

In this system, the material powder is fed into the quantitative feeder 2 with a suitable means, and through the vibrating feeder 3 and through the material feed nozzle 16, introduced into the tripartition classifier 1. The material powder may preferably be fed into the tripartition classifier 1 at a speed of 50 to 300 m/sec, utilizing a gas jetted from the injection nozzle 31 in a high speed. The classifying chamber of the tripartition classifier 1 is usually a size of [10 to 50 cm]×[10 to 50 cm], so that the material powder can be instantaneously classified, within 0.1 to 0.01 second, into three or more fractions. The material powder is classified by the tripartition classifier 1 into the fraction of larger particles (coarse powder), fraction of medium particles (medium powder) and fraction of smaller particles (fine powder). Thereafter, the fraction of larger particles is sent to and collected in the collecting cyclone 6 passing through a discharge guide pipe 11*a*. The fraction of medium particles is discharged from the classifier through the discharge pipe 12*a*, and collected in the collecting cyclone 5. The fraction of smaller particles is discharged outside the classifier through the discharge pipe 13*a* and collected in the collecting cyclone 4. The collecting cyclones 4, 5 and 6 may also function as suction-evacuation means for introducing the material powder to the classifying chamber through the material feed nozzle 16.

The gas current classifier of the present invention is effective especially when toners for electrophotographic image formation or colored resin powders for toners are classified. In particular, it is effective for classification of toner compositions containing a binder resin of low melting point, low softening point and low glass transition point.

If the toner compositions containing such a binder resin are fed to conventional classifiers, particles easily melt-adhere to the tips of classifying edges, resulting in deviation of classification points from suitable values. Even if the flow rate is adjusted by suction-evacuation, it is difficult to obtain the required particle size distribution, resulting in a decrease in classification efficiency. Moreover, the melted matter may contaminate the classified powder to make it difficult to obtain products of good quality.

In the classifier of the present invention, when the classifying edges 17 and 18 are shifted, concurrently shifted are the classifying edge blocks 24 and 25 so that the classifying edges are shifted along the directions of particle streams flying along the Coanda block 26, whereupon the flow of suction streams are adjusted through the discharge pipes 11*a*, 12*a* and 13*a* serving as a suction-evacuation means. Thus, the flying speed of particles can be increased to improve the dispersion of powder in the classification zone so that the classification yield can be improved and also the particles can be prevented from adhering to the tips of classifying edges, enabling effective high-precision classification.

The smaller the particle diameter is, the more effective the classifier of the present invention becomes. Classified products having a sharp particle size distribution can be obtained especially when powders with a weight average particle diameter of 10 μm or smaller are classified. Classified products having a sharp particle size distribution can also be obtained when powders with a weight average particle diameter of 6 μm or smaller are classified.

In the classifier of the present invention, the direction of each classifying edge and the edge tip position may be changed by means of a stepping motor as a shifting means and the edge tip position may be detected by means of a potentiometer as a detecting means. A control device for controlling these may control the tip positions of classifying edges and also the control of flow rates may be automated. This is more preferable since the desired classification points can be obtained in a short time and more accurately.

Figure 5:
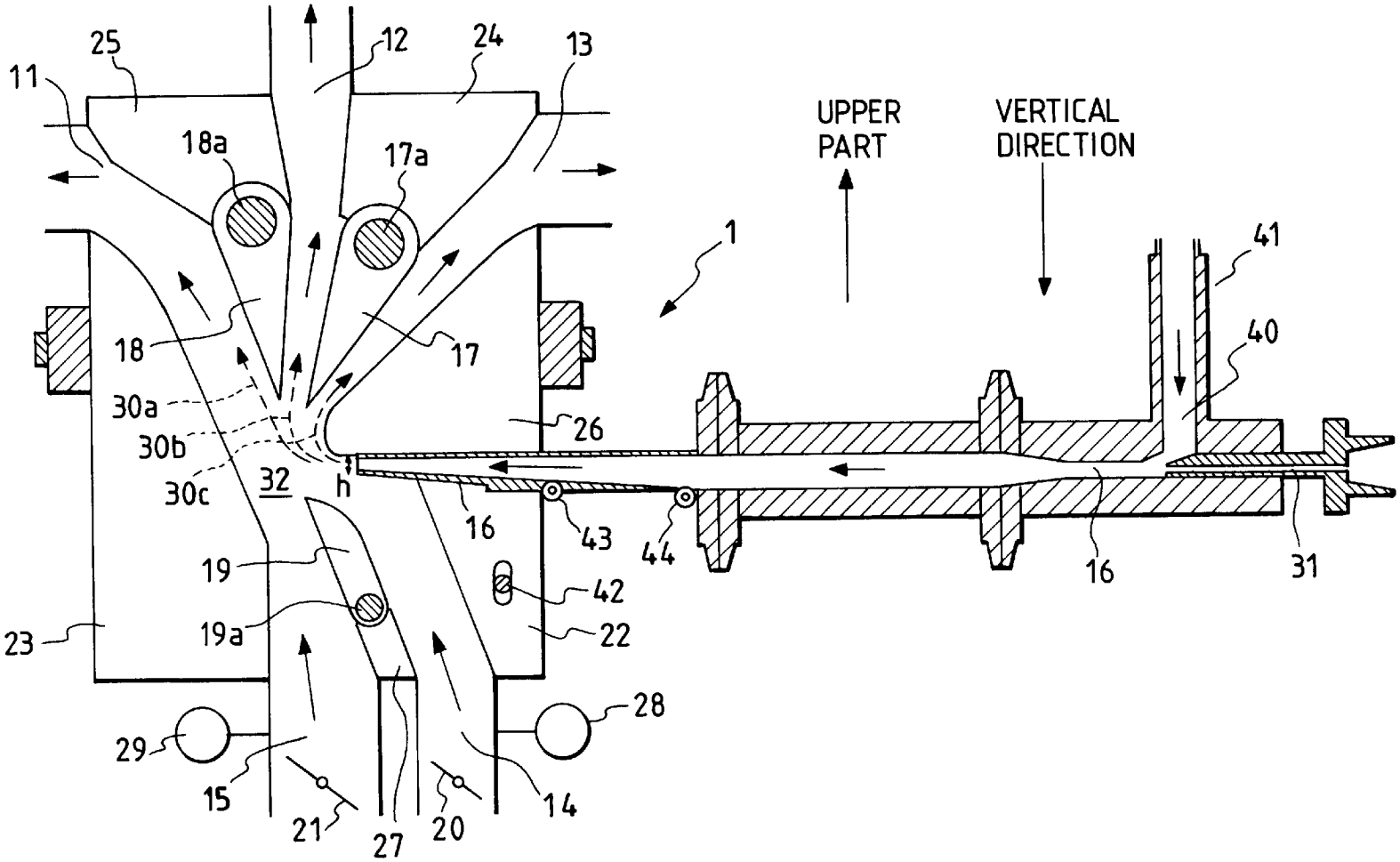
FIG. 5 is a schematic cross section of a gas current classifier according to another embodiment of the present invention.

FIG. 5 illustrates an example of a gas current classifier in which the height-direction diameter $L_0$ of the orifice 16*a* of the material feed nozzle 16 is adjustable.

Figure 6:
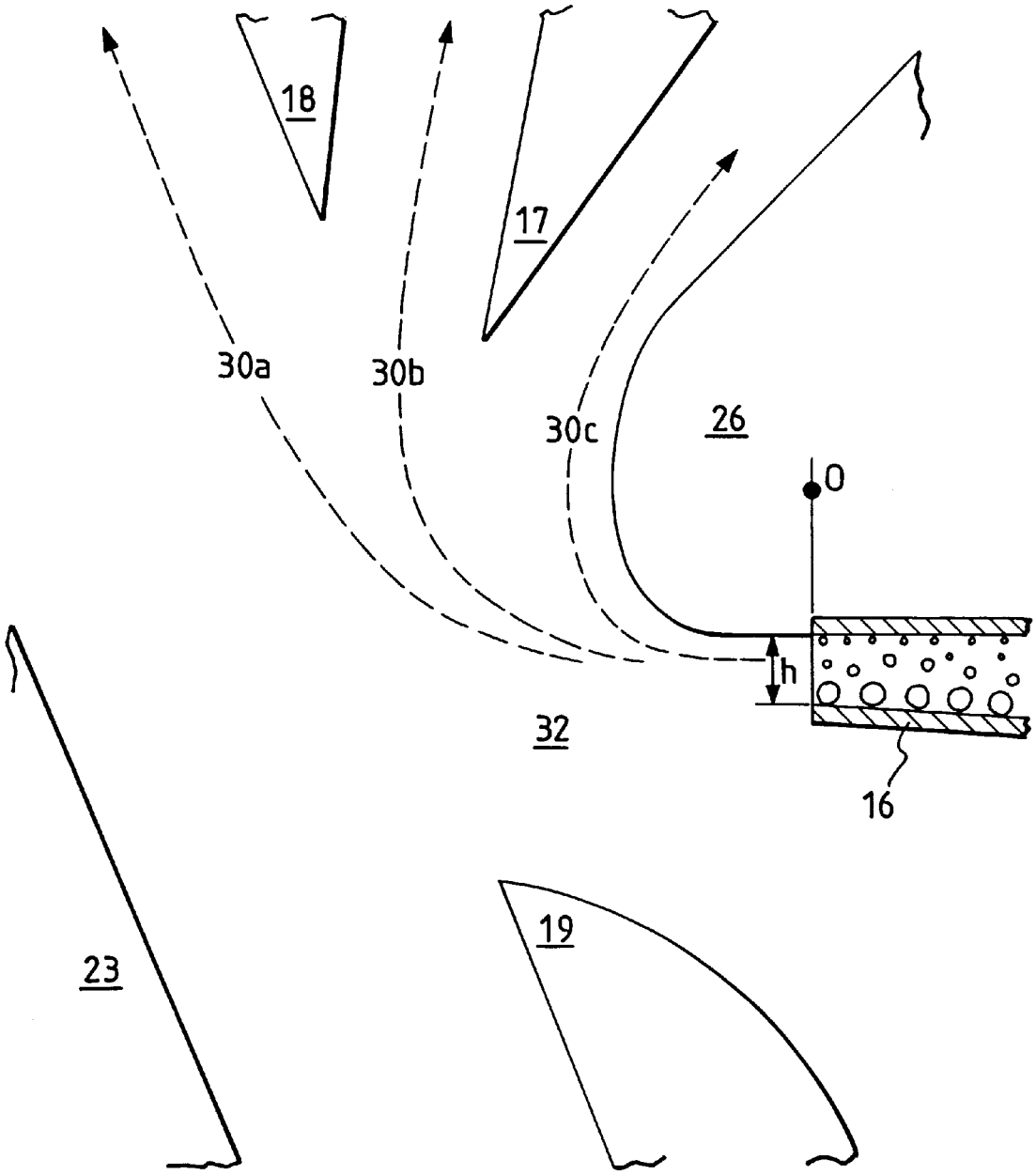
FIG. 6 is an enlarged view of the orifice of the material feed nozzle, and the vicinity thereof, in the gas current classifier of the present invention.

FIG. 5 shows the whole cross section of such an example of the gas current classifier according to the present invention. FIG. 6 is an enlarged view of the orifice of the material feed nozzle, and the vicinity thereof, in the gas current classifier shown in FIG. 5.

As shown in FIGS. 5 and 6, side walls 22 and 23 form a lower part of the classifying chamber 32, and classifying edge blocks 24 and 25 provided at the upper part have classifying edges 17 and 18, respectively. The classifying edges 17 and 18 rotatable around shafts 17*a* and 18*a*, respectively, and thus the tip position of each classifying edge can be shifted by rotating the classifying edges 17 or 18. These classifying edges 17 and 18 divide the classification zone of the classifying chamber 32 into three partitions as shown in FIG. 5.

Above the side wall 22, a material feed nozzle 16 having an orifice in the classifying chamber 32 is provided, and a Coanda block 26 is disposed above the material feed nozzle 16 curving upward from the extension line of the top wall of the material feed nozzle 16. The classifying chamber 32 has at its lower part a lower block 27 provided with a knife edge-shaped gas-intake edge 19 extending upward. Like the classifying edges 17 and 18, the knife edge-shaped gas-intake edge 19 is also rotatable around a shaft 19*a*, and thus the tip position of the gas-intake edge 19 can be freely changed.

As shown in FIG. 5, at the top of the classifying chamber 32, discharge ports 11, 12 and 13 having openings to the classifying chamber are provided correspondingly to the respective classification zones.

The side wall 22 is slidable up and down along a location member 42. As it is slid, the bottom wall of the material feed nozzle 16 underneath of which shafts 43 and 44 are provided, is smoothly moved up and down, and thus the height-direction diameter $L_0$ ("h" in FIGS. 5 and 6) of the orifice of the material feed nozzle 16 can be changed.

Figure 7:
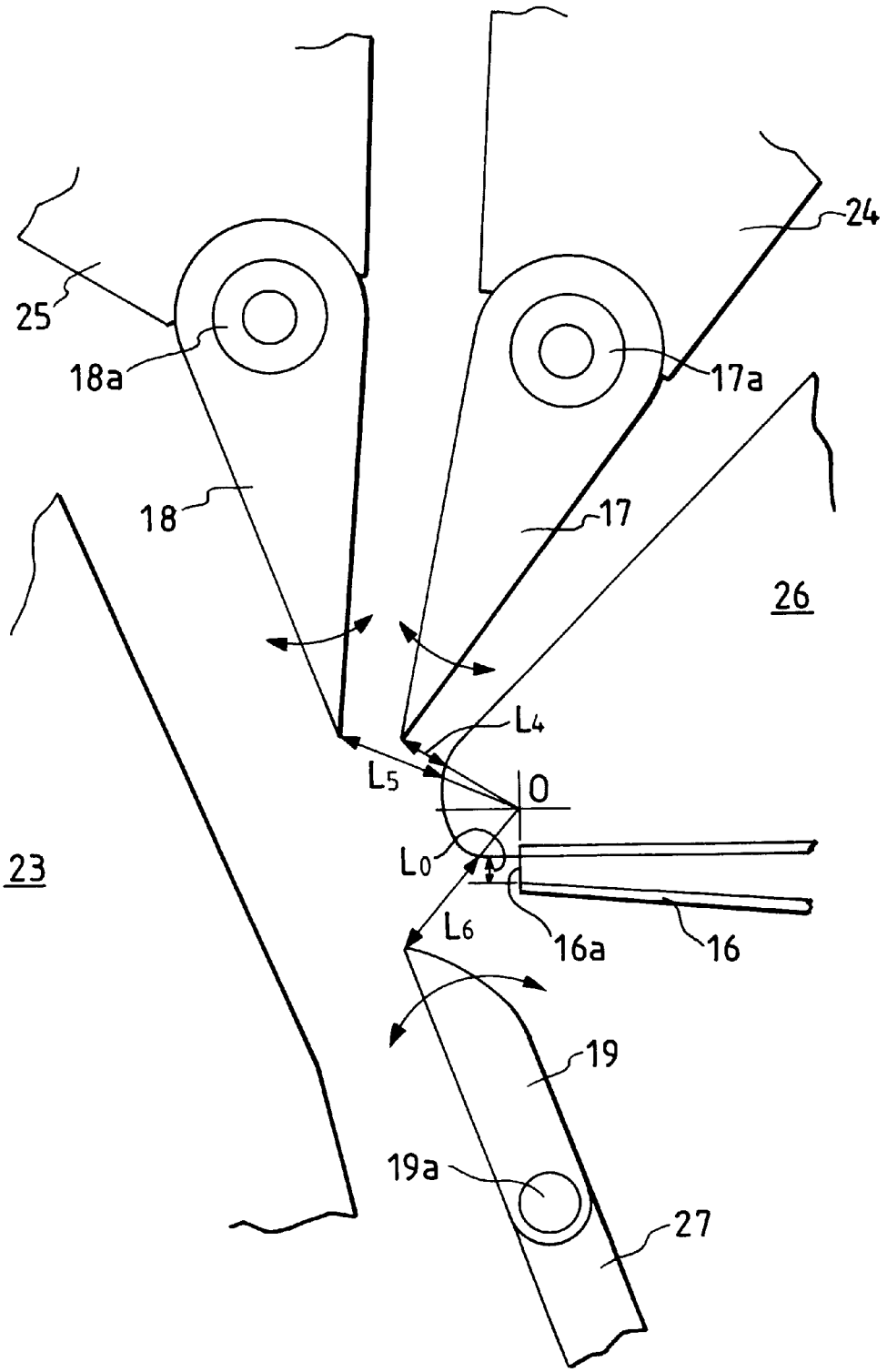
FIG. 7 illustrates the main part in FIG. 5.

As shown in FIG. 7, assuming a position O in the Coanda block 26, on the vertical extension line of the orifice 16*a* of the material feed nozzle 16 as the central point, a distance $L_4$ between the tip of the classifying edge 17 and the wall surface of the Coanda block 26 can be adjusted by rotating the tip of the classifying edge 17 around the shaft 17*a*. Similarly, a distance $L_5$ between the tip of the classifying edge 18 and the edge surface of the Coanda block 26 can be adjusted by rotating the tip of the classifying edge 18 around the shaft 18*a*. The Coanda block 26 and the classifying edges 17 and 18 are positioned above the orifice 16*a* of the material feed nozzle 16, and the height-direction diameter $L_0$ is changed according to the properties of material powder, so that the classification zone in the classifying chamber is widened, and the classification points can be adjusted with ease over a wide range.

The gas current classifier of the present invention is effective especially when toner particles for electrophotographic image formation are classified. In particular, it is effective for the toner particles contain a binder resin of low melting point, low softening point and low glass transition point.

If the toner particles containing such a binder resin are fed to a conventional classifier, particles tend to melt-adhere especially to the tips of classifying edges.

Figure 8:
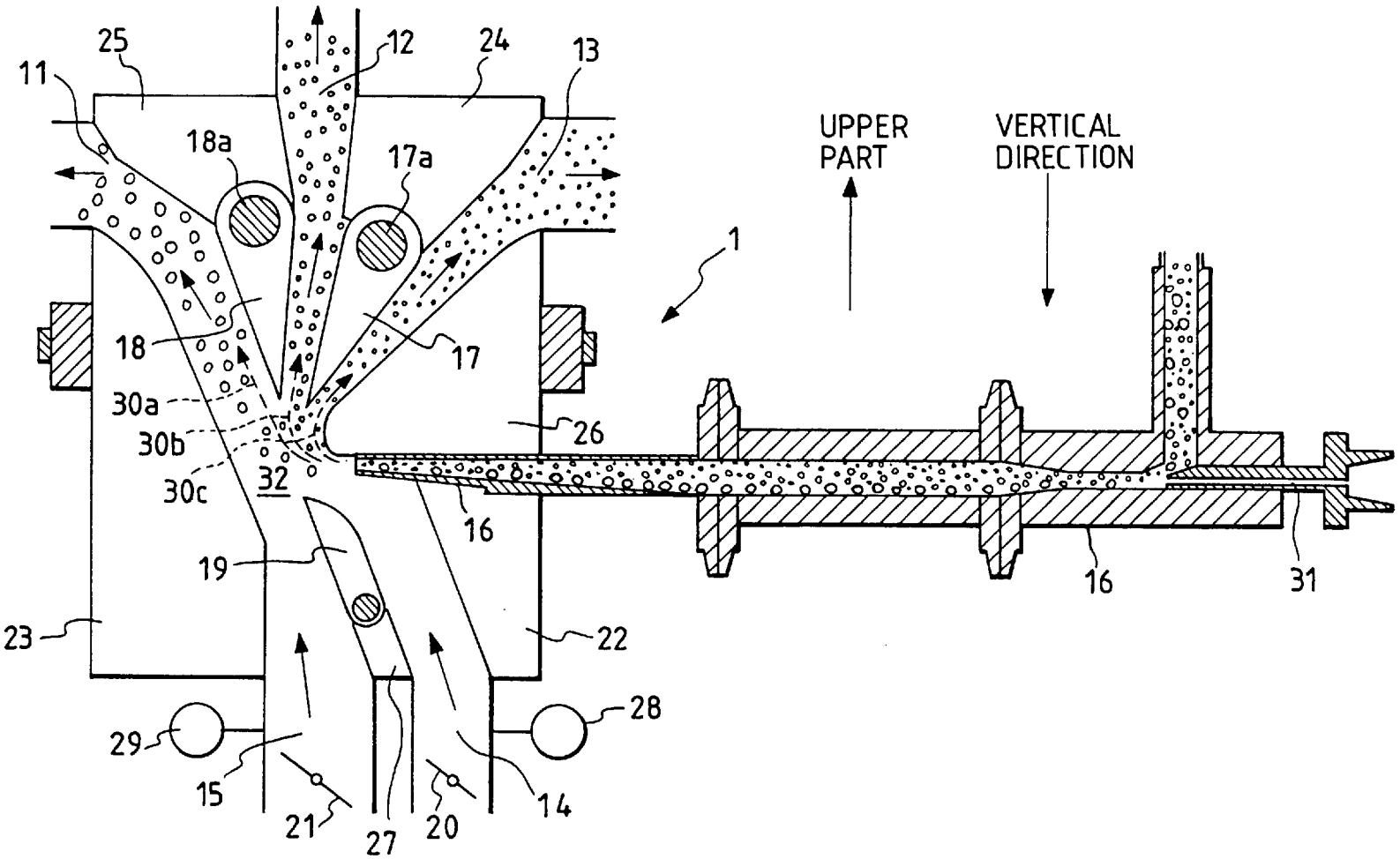
FIG. 8 is a schematic cross section of a gas current classifier according to still another embodiment of the present invention.

FIG. 8 illustrates the gas current classifier according to still another embodiment of the present invention. In the gas current classifier shown in FIG. 8, the classifying edge blocks 24 and 25 and the side wall 22 are fixed.

In following Production Examples, a coarse crushed material for toner production is finely pulverized and subjected to classification. In the following, "part(s)" refers to "part(s) by weight" unless particularly noted.

PRODUCTION EXAMPLE 1

Styrene/butyl acrylate/divinylbenzene copolymer (binder resin; monomer polymerization ratio (weight): 80.0/19.0/1.0; weight average molecular weight (Mw): 350,000) 100 parts Magnetic iron oxide (colorant and magnetic material; average particle diameter: 0.18 μm) 100 parts Nigrosine (charge control agent) 2 parts Low-molecular weight ethylene/propylene copolymer (anti-offset agent) 4 parts The above materials were thoroughly mixed using a Henschel mixer (FM-75 Type, manufactured by Mitsui Miike Engineering Corporation), and thereafter kneaded using a twin-screw kneader (PCM-30 Type, manufactured by Ikegai Corp.) at a set temperature of 150° C. The kneaded product obtained was cooled, and then crushed by means of a hammer mill to a size of 1 mm or less to obtain a crushed material for toner production. The crushed material was pulverized using an impact type air pulverizer to obtain a pulverized material having a weight average particle diameter of 6.7 μm, which had a true density of 1.73 g/cm$^{3}$.

The pulverized material thus obtained was introduced into the multi-partition classifier 1 shown in FIG. 1 at a rate of 35.0 kg/hr, passing through the feeder 2, the vibrating feeder 3 and the material feed pipe 16 to be classified into three fractions, coarse powder, medium powder and fine powder, with the Coanda effect.

The material powder was introduced by the action of the suction force derived from the suction-evacuation of the inside of the system by suction evacuation by the collecting cyclones 4, 5 and 6 through the discharge ports 11, 12 and 13, and the compressed air fed from the injection nozzle 31 fitted to the material feed pipe 16.

In order to change the form of the classification zone, the respective location distances were set as shown below, to carry out classification.

$L_0$: 6 mm (the height of the material feed nozzle discharge orifice 16*a* )

$L_1$: 34 mm (the distance between the sides of the classifying edge 17 and the Coanda block 26)

$L_2$: 33 mm (the distance between the sides of the classifying edge 17 and the classifying edge 18)

$L_3$: 37 mm (the distance between the sides of the classifying edge 18 and the surface of the side wall 23)

$L_4$: 15 mm (the distance between the tip of the classifying edge 17 and the side of the Coanda block 26)

$L_5$: 35 mm (the distance between the tip of the classifying edge 18 and the side of the Coanda block 26)

$L_6$: 25 mm (the distance between the tip of the gas-intake edge 19 and the side of the Coanda block 26)

R: 14 mm (R is the length between the position O to the edge of the Coanda block 26 on a line connecting the position O and the tip of the intake edge 19)

The pulverized material thus introduced was instantaneously classified within 0.1 second. The medium powder obtained by classification had a sharp particle size distribution with a weight average particle diameter of 6.9 μm, containing 22% by number of particles with particle diameters of 4.0 μm or smaller and containing 1.0% by volume of particles with particle diameters of 10.08 μm or larger, and was obtainable in a classification yield (the percentage of the medium powder finally obtained, to the total weight of the pulverized material fed) of 92%, having a good performance for use in toner. The coarse powder obtained by classification was again returned to the step of pulverization.

In the present invention, the true density of the pulverized material for toner was measured using Micrometrix Acupic 1330 (manufactured by Shimadzu Corporation) as a measuring device, and 5 g of the colored resin powder was weighed to determine its true density.

The particle size distribution of the toner can be measured by various methods. In the present invention, it was measured using the following measuring device.

A Coulter counter TA-II or Coulter Multisizer II (manufactured by Coulter Electronics, Inc.) was used as a measuring device. As an electrolyte solution, an aqueous 1% NaCl solution was prepared using sodium chloride of first grade. For example, ISOTON-II (trade name; available from Coulter Scientific Japan Co.) can be used. Measurement was carried out by adding as a dispersant 0.1 to 5 ml of a surface active agent, preferably an alkylbenzene sulfonate, to 100 to 150 ml of the above aqueous electrolyte solution, and further adding 2 to 20 mg of a sample to be measured. The electrolyte solution in which the sample had been suspended was subjected to dispersion for about 1 minute to about 3 minutes in an ultrasonic dispersion machine. The volume and number of toner particles were measured by means of the above measuring device, using an aperture of 100 μm to calculate the volume distribution and number distribution of the toner particles. Then, weight-based weight average particle diameter obtained from the volume distribution of the toner particles was determined.

PRODUCTION EXAMPLES 2 TO 4

The pulverized materials shown in Table 1 were obtained by pulverizing the same crushed material as used in Production Example 1 for the toner, by means of an impact type air pulverizer. They were classified using the same system except that the location distances were set as shown in Table 1.

As shown in Tables 2 and 3, medium powders all having a sharp particle size distribution were obtained in a good efficiency, which had good properties for the toner.

TABLE 1

| Production Example: | Pulverized material (1) ($\mu$m) | (2) (g/cm$^3$) | (3) (kg/h) | Location distances in classification zone (mm) $L_0$ | $L_1$ | $L_2$ | $L_3$ | $L_4$ | $L_5$ | $L_6$ | R |
|---|---|---|---|---|---|---|---|---|---|---|---|
| 1 | 6.7 | 1.73 | 35.0 | 6 | 34 | 33 | 37 | 15 | 35 | 25 | 14 |
| 2 | 6.3 | 1.73 | 31.0 | 6 | 34 | 32 | 38 | 14 | 33 | 25 | 14 |
| 3 | 5.2 | 1.73 | 25.0 | 6 | 30 | 34 | 39 | 13 | 32 | 25 | 14 |
| 4 | 5.2 | 1.73 | 25.0 | 6 | 34 | 30 | 39 | 16 | 33 | 25 | 14 |

(1): Weight average particle diameter
(2): True density
(3): Feeding rate into classifier

TABLE 2

| Production Example: | Weight average particle diameter ($\mu$m) | Medium powder Particle size distribution Particles with particle diameters of: 4.00 $\mu$m or smaller (% by number) | 10.08 $\mu$m or larger (% by volume) | Classification yield (%) |
|---|---|---|---|---|
| 1 | 6.9 | 22 | 1.0 | 92 |
| 2 | 5.9 | 25 | 0.2 | 89 |

TABLE 3

| Production Example: | Weight average particle diameter ($\mu$m) | Medium powder Particle size distribution Particles with particle diameters of: 3.17 $\mu$m or smaller (% by number) | 8.00 $\mu$m or larger (% by volume) | Classification yield (%) |
|---|---|---|---|---|
| 3 | 5.4 | 20 | 1.2 | 85 |
| 4 | 5.4 | 20 | 1.9 | 87 |

PRODUCTION EXAMPLES 5 & 6

Unsaturated polyester resin (binder resin) 100 parts

Copper phthalocyanine pigment (colorant; C.I. Pigment Blue 15) 4.5 parts

Charge control agent 4.0 parts

The above materials were thoroughly mixed using the same Henschel mixer as used in Production Example 1, and thereafter kneaded using the same twin-screw kneader as used in Production Example 1 at a set temperature of 100° C. The kneaded product obtained was cooled, and then crushed by means of a hammer mill to a size of 1 mm or less to obtain a crushed material for toner production. The crushed material was pulverized using an impact type air pulverizer to obtain a pulverized material having a weight average particle diameter of 6.5 $\mu$m (Production Example 5), which had a true density of 1.08 g/cm$^3$.

The pulverized material obtained was classified using the same system as in Production Example 1 except that the classification was carried out under conditions as shown in Table 4.

Otherwise, the above crushed material was pulverized using an impact type air pulverizer to obtain a pulverized material having a weight average particle diameter of 5.5 $\mu$m (Production Example 6), which was then classified under conditions as shown in Table 4.

As shown in Tables 5 and 6, medium powders all having a sharp particle size distribution were obtainable in a good efficiency, which had good properties for the toner.

TABLE 4

| Production Example: | Pulverized material (1) ($\mu$m) | (2) (g/cm$^3$) | (3) (kg/h) | Location distances in classification zone (mm) $L_0$ | $L_1$ | $L_2$ | $L_3$ | $L_4$ | $L_5$ | $L_6$ | R |
|---|---|---|---|---|---|---|---|---|---|---|---|
| 5 | 6.5 | 1.08 | 31.0 | 6 | 28 | 17 | 35 | 16 | 30 | 25 | 8 |
| 6 | 5.5 | 1.08 | 24.0 | 9 | 26 | 17 | 39 | 16 | 29 | 25 | 8 |

(1): Weight average particle diameter
(2): True density
(3): Feeding rate into classifier

TABLE 5

| | Weight average particle diameter (μm) | Medium powder Particle size distribution Particles with particle diameters of: 4.00 μm or smaller (% by number) | 10.08 μm or larger (% by volume) | Classification yield (%) |
|---|---|---|---|---|
| Production Example: | | | | |
| 5 | 5.9 | 21 | 1.0 | 80 |

TABLE 6

| | Weight average particle diameter (μm) | Medium powder Particle size distribution Particles with particle diameters of: 3.17 μm or smaller (% by number) | 8.00 μm or larger (% by volume) | Classification yield (%) |
|---|---|---|---|---|
| Production Example: | | | | |
| 6 | 5.7 | 10 | 1.8 | 78 |

COMPARATIVE PRODUCTION EXAMPLES 1 TO 3

Using the same toner materials as used in Production Example 1, the crushed material was pulverized using the impact type air pulverizer to obtain a pulverized material having a weight average particle diameter of 6.9 μm (Comparative Production Example 1) and a pulverized material having a weight average particle diameter of 5.5 μm (Comparative Production Example 2).

The toner materials were replaced with those as used in Production Example 5 to obtain a pulverized material having a weight average particle diameter of 6.5 μm (Comparative Production Example 3).

Figure 9:
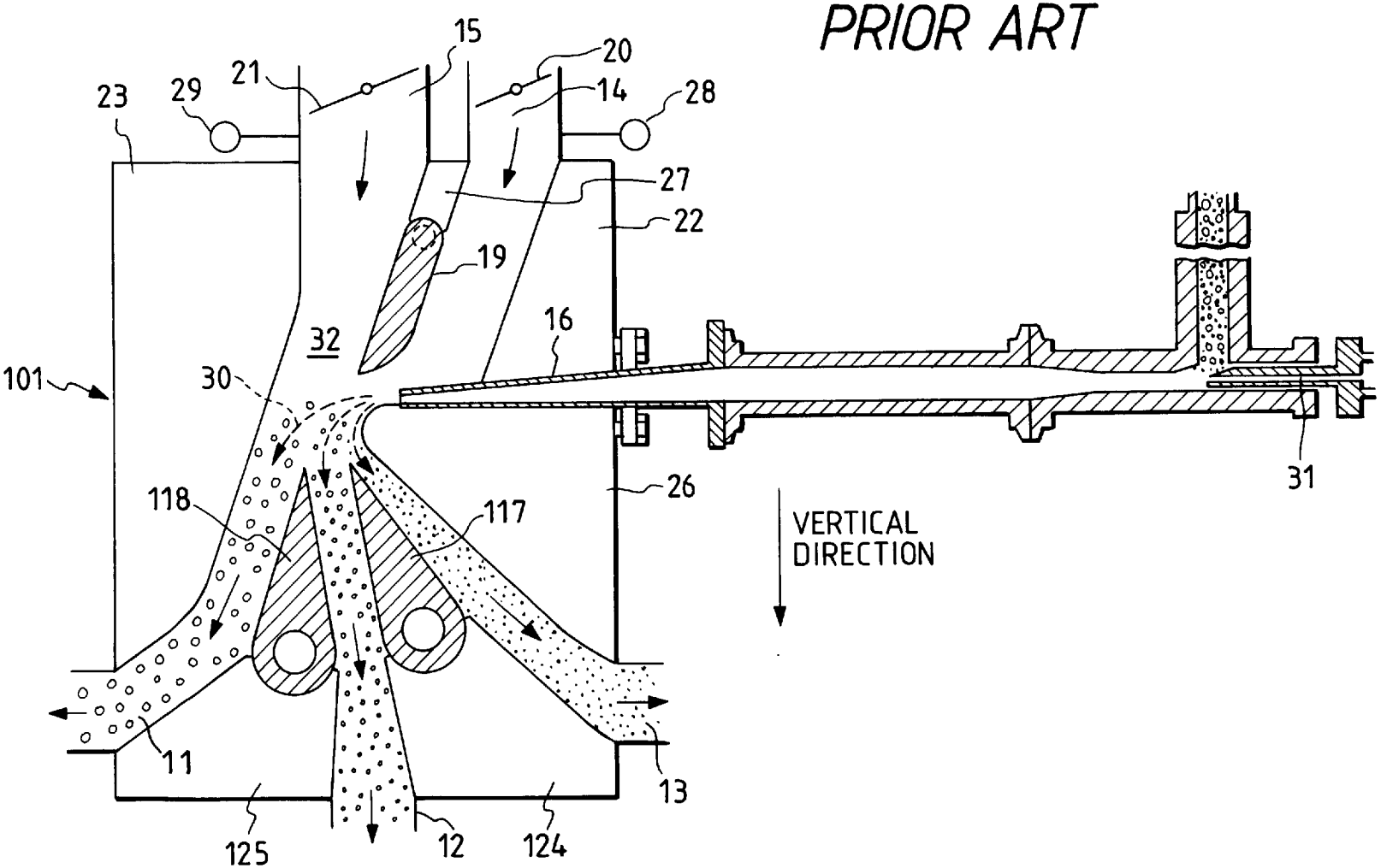
FIG. 9 PRIOR ART
FIG. 9 is a schematic cross section of a conventional gas current classifier.
Figure 10:
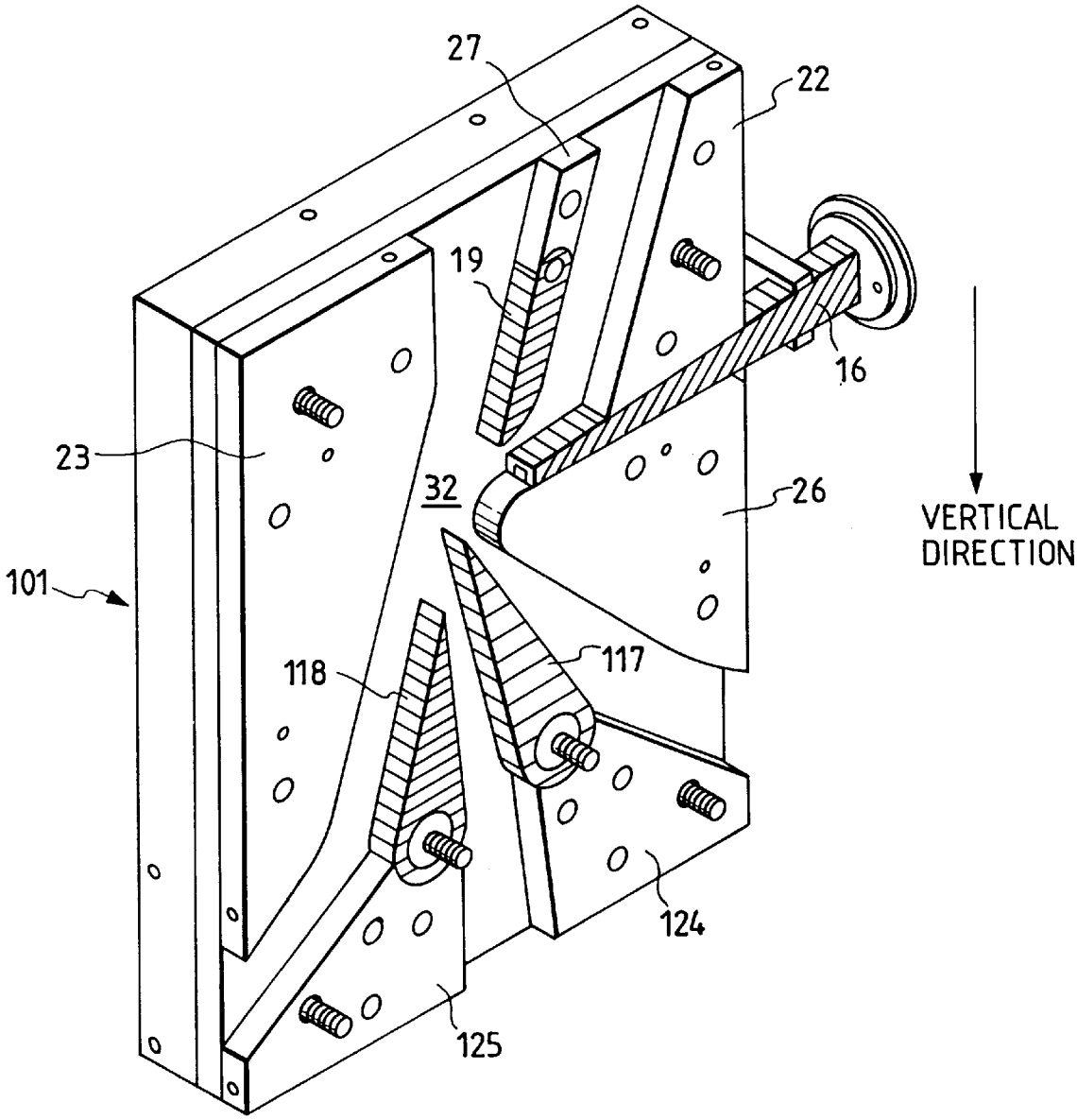
FIG. 10 PRIOR ART
FIG. 10 is an exploded perspective view of the conventional gas current classifier.

The pulverized materials obtained were each classified according to the flow chart as shown in FIG. 11, using the multi-partition classifier as shown in FIGS. 9 and 10.

The classification of each powder was carried out under conditions as shown in Table 7, and the particle size distribution and so forth of the medium powders obtained by the classification were as shown in Tables 8 to 10.

TABLE 7

| Comparative Production Example: | Pulverized material (1) (μm) | (2) (g/cm³) | (3) (kg/h) | Location distances in classification zone (mm) $L_0$ | $L_1$ | $L_2$ | $L_3$ | $L_4$ | $L_5$ | $L_6$ | R |
|---|---|---|---|---|---|---|---|---|---|---|---|
| 1 | 6.9 | 1.73 | 30.0 | 6 | 30 | 25 | 55 | 17 | 29 | 25 | 14 |
| 2 | 5.5 | 1.73 | 25.0 | 6 | 30 | 25 | 55 | 14 | 29 | 25 | 14 |
| 3 | 6.5 | 1.08 | 31.0 | 6 | 30 | 25 | 55 | 14 | 25 | 25 | 14 |

(1): Weight average particle diameter
(2): True density
(3): Feeding rate into classifier

TABLE 8

| | Weight average particle diameter (μm) | Medium powder Particle size distribution Particles with particle diameters of: 4.00 μm or smaller (% by number) | 10.08 μm or larger (% by volume) | Classification yield (%) |
|---|---|---|---|---|
| Comparative Production Example: | | | | |
| 1 | 6.9 | 28 | 2.0 | 75 |

TABLE 9

| | Weight average particle diameter (μm) | Medium powder Particle size distribution Particles with particle diameters of: 3.17 μm or smaller (% by number) | 8.00 μm or larger (% by volume) | Classification yield (%) |
|---|---|---|---|---|
| Comparative Production Example: | | | | |
| 2 | 5.1 | 41 | 2.0 | 65 |

TABLE 10

| | Weight average particle diameter (μm) | Medium powder Particle size distribution Particles with particle diameters of: 4.00 μm or smaller (% by number) | 10.08 μm or larger (% by volume) | Classification yield (%) |
|---|---|---|---|---|
| Comparative Production Example: | | | | |
| 3 | 5.9 | 35 | 2.8 | 75 |

PRODUCTION EXAMPLE 7

Styrene/butyl acrylate/divinylbenzene copolymer (binder resin; monomer polymerization weight ratio: 80.0/19.0/1.0; weight average molecular weight (Mw): 350,000) 100 parts Magnetic iron oxide (colorant and magnetic material; average particle diameter: 0.18 μm) 100 parts
Nigrosine (charge control agent) 2 parts
Low-molecular weight ethylene/propylene copolymer (anti-offset agent) 4 parts First, the above materials were thoroughly mixed using a Henschel mixer (FM-75 Type, manufactured by Mitsui Miike Engineering Corporation), and thereafter kneaded using a twin-screw kneader (PCM-30 Type, manufactured by Ikegai Corp.) at a set temperature of 150° C. The kneaded product obtained was cooled, and then crushed by means of a hammer mill to a size of 1 mm or less to obtain a crushed material for toner production. The crushed material was pulverized using an impact type air pulverizer to obtain a pulverized material having a weight average particle diameter of 7.0 μm and a true density of 1.5 g/cm$^{3}$.

Next, the pulverized material thus obtained was introduced into the multi-partition classifier 1 shown in FIG. 5, at a rate of 35.0 kg/hr, passing through the quantitative feeder 2, the vibrating feeder 3 and the material feed nozzle 16 to be classified into three fractions, coarse powder, medium powder and fine powder, with the Coanda effect.

The material powder was introduced by the action of the suction force derived from the suction-evacuation of the inside of the system by suction evacuation by the collecting cyclones 4, 5 and 6 through the discharge ports 11, 12 and 13, and the compressed air fed from the injection nozzle 31 fitted to the material feed nozzle 16. The height $L_0$ of the orifice of the material feed nozzle was set at 8 mm. As a result, the pulverized material introduced from the nozzle 16 was instantaneously classified, within 0.1 second.

The medium powder thus obtained by classification had a sharp particle size distribution with a weight average particle diameter of 6.8 μm, containing 24% by number of particles with particle diameters of 4.0 μm or smaller and containing 1.0% by volume of particles with particle diameters of 10.08 μm or larger, and was obtainable in a high classification yield of 80%. The medium powder obtained had good properties as toner materials. After the operation, the orifice of the material feed nozzle 16 was observed to find that no melt-adhesion had occurred.

PRODUCTION EXAMPLE 8

The same crushed toner material as used in Production Example 7 for was pulverized by means of an impact type air pulverizer to obtain a pulverized material with a weight average particle diameter of 6.4 μm. The pulverized material was classified using the same classification system as in Production Example 7.

The pulverized material was introduced into the multi-partition classifier at a rate of 31.0 kg/hr, and a medium powder having a sharp particle size distribution with a weight average particle diameter of 5.9 μm, containing 30% by number of particles with particle diameters of 4.0 μm or smaller and containing 0.2% by volume of particles with particle diameters of 10.08 μm or larger, was obtained in a high classification yield of 76%. The medium powder obtained had good properties as the toner material. After the operation, the orifice of the material feed nozzle 16 was observed to find that no melt-adhesion had occurred. The coarse powder obtained by classification was returned to the step of pulverization, i.e., the step preceding the step of classification, and again circulated.

PRODUCTION EXAMPLE 9

The same crushed toner material as used in Production Example 7 was pulverized by means of an impact type air pulverizer to obtain a pulverized material with a weight average particle diameter of 5.5 pm. The pulverized material was classified using the same classification system as in Production Example 7.

The pulverized material was introduced into the multi-partition classifier at a rate of 25.0 kg/hr, and a medium powder having a sharp particle size distribution with a weight average particle diameter of 5.2 μm, containing 30% by number of particles with particle diameters of 3.17 μm or smaller and containing 2.6% by volume of particles with particle diameters of 8.00 μm or larger, was obtained in a high classification yield of 72%. The medium powder obtained had good properties as the toner material. After the operation, the orifice of the material feed nozzle 16 was observed to find that no melt-adhesion had occurred. The coarse powder obtained by classification was returned to the step of pulverization, i.e., the step preceding the step of classification, and again circulated.

PRODUCTION EXAMPLE 10

The same crushed material as used in Production Example 7 for producing the toner was pulverized by means of an impact type air pulverizer to obtain a pulverized material with a weight average particle diameter of 5.5 μm. The pulverized material was classified using the same classification unit system as in Production Example 7.

The pulverized material was introduced into the multi-partition classifier at a rate of 25.0 kg/hr, whereby a medium powder having a sharp particle size distribution with a weight average particle diameter of 5.4 μm, containing 20% by number of particles with particle diameters of 3.17 μm or smaller and containing 1.9% by volume of particles with particle diameters of 8.00 μm or larger, was obtained in a high classification yield of 70%. The medium powder obtained had a good properties as the toner material. After the operation, the orifice of the material feed nozzle 16 was observed to find that no melt-adhesion had occurred. The coarse powder obtained by classification was returned to the step of pulverization, i.e., the step preceding the step of classification, and again circulated.

PRODUCTION EXAMPLE 11

Unsaturated polyester resin (binder resin) 100 parts
Copper phthalocyanine pigment (colorant; C.I. Pigment Blue 15) 4.5 parts
Charge control agent 4.0 parts The above materials were thoroughly mixed using a Henschel mixer (FM-75 Type, manufactured by Mitsui Miike Engineering Corporation), and thereafter kneaded using a twin-screw kneader (PCM-30 Type, manufactured by Ikegai Corp.) at a set temperature of 100° C. The kneaded product obtained was cooled, and then crushed by means of a hammer mill to a size of 1 mm or less to obtain a crushed toner material. The crushed material was pulverized using an impact type air pulverizer to obtain a pulverized material having a weight average particle diameter of 6.5 μm and a true density of 1.1 g/cm$^{3}$.

Next, the pulverized material thus obtained was introduced into the multi-partition classifier shown in FIG. 5 at a rate of 31.0 kg/h, through the quantitative feeder 2, the vibrating feeder 3 and the material feed nozzle 16, to classify the pulverized material into the three fractions, coarse powder, medium powder and fine powder utilizing the Coanda effect.

The material powder was introduced by the action of the suction force due to the evacuation of the inside of the system utilizing the collecting cyclones 4, 5 and 6 communicating through the discharge ports 11, 12 and 13, as well as the compressed air fed from the injection nozzle 31 fitted to the material feed nozzle 16. The pulverized material thus introduced from the material feed nozzle 16 was instantaneously classified within 0.1 second.

The medium powder thus obtained by classification had a sharp particle size distribution with a weight average particle diameter of 5.9 μm, containing 24% by number of particles with particle diameters of 4.0 μm or smaller and containing 1.0% by volume of particles with particle diameters of 10.08 μm or larger, and was obtainable in a high classification yield of 80%. The medium powder obtained had good properties as the toner material. After the operation, the orifice of the material feed nozzle 16 was observed to find that no melt-adhesion had occurred. The coarse powder obtained by classification was returned to the step of pulverization, i.e., the step preceding the step of classification, and again circulated.

What is claimed is:

1. A gas current classifier comprising a classifying chamber, a material feed nozzle for introducing a material powder in a gas stream into the classification zone of the classifying chamber, a Coanda block for classifying the material powder thus introduced by the Coanda effect to separate the powder into at least a fraction of fine powder, a fraction of medium powder and a fraction of coarse powder, and a low block at the lower part of the classifying chamber, wherein said classification zone is defined by at least the Coanda block and a classifying edge, A location of said classifying edge is changeable, said low block has a knife edge-shaped gas-intake edge and gas-intake pipes opening to the classifying chamber for introducing a rising current of air into the classification zone, a location of said gas-intake edge is changeable, said material feed nozzle has a material receiving opening at the upper part of the material feed nozzle for introducing the material powder into the material feed nozzle and an injection nozzle at the rear end of the material feed nozzle, such that said material powder is accelerated by the gas stream fed through the injection nozzle within the material feed nozzle, a fraction of fine powder in the material powder forms an upper stream within the material feed nozzle and a fraction of coarse powder in the material powder forms a lower stream within the material feed nozzle; and said Coanda block is provided at a position higher than the orifice of the material feed nozzle for classifying the powder as the rising current of air from the gas-intake pipes lifts the powder into the classifying zone, whereby the flows of the upper stream and the lower stream are not disturbed, the flow of coarse powder is classified in an outer circumference of the classifying zone and the flow of fine powder is classified in an inner circumference of the classifying zone, by the Coanda effect.

2. The gas current classifier according to claim 1, wherein said material receiving opening is provided in the manner that fine particles in the material powder in the material feed nozzle come to take upper position in the material feed nozzle by the Coanda effect.

3. The gas current classifier according to claim 1, wherein a discharge port from which the fraction of fine powder classified by the Coanda effect is discharged from the classifying chamber is provided at a position higher than the orifice of the material feed nozzle.

4. The gas current classifier according to claim 1, wherein said classifying edge is provided at a position higher than the orifice of the material feed nozzle.

5. The gas current classifier according to claim 4, wherein said classifying edge is provided in plurality in said classifying chamber.

6. The gas current classifier according to claim 1, wherein said classifying edge is held by a classifying edge block, and the classifying edge block is set up in the manner that its location is changeable so that the shape of the classification zone can be changed.

7. The gas current classifier according to claim 6, wherein the location of said classifying edge is changeable with the change of the location of said classifying edge block.

8. The gas current classifier according to claim 6 or 7, wherein said classifying edge is held by said classifying edge block in the manner that the tip of the classifying edge is rotatable.

9. The gas current classifier according to claim 6, wherein the location of said classifying edge block is changeable in the horizontal direction or in substantially the horizontal direction.

10. The gas current classifier according to claim 6, wherein the location of said classifying edge is changeable in the horizontal direction or in substantially the horizontal direction.

11. The gas current classifier according to claim 6, wherein the material receiving opening is provided in the manner that the fine particles in the material powder come take upper position in the material feed nozzle by the Coanda effect when the material powder is fed into the material feed nozzle through the material receiving opening.

12. The gas current classifier according to claim 11, wherein a discharge port from which the fraction of fine powder classified by the Coanda effect is discharged from the classifying chamber is provided at a position higher than the orifice of the material feed nozzle.

13. The gas current classifier according to claim 6, wherein said classifying edge is provided at a position higher than the orifice of the material feed nozzle.

14. The gas current classifier according to claim 6, wherein said classifying edge is provided in plurality so that the material powder is classified into at least a fraction of fine powder, a fraction of medium powder and a fraction of coarse powder.

15. The gas current classifier according to claim 1, wherein said material feed nozzle is constructed in the manner that the height of its orifice is changeable.

* * * * *

UNITED STATES PATENT AND TRADEMARK OFFICE

CERTIFICATE OF CORRECTION

PATENT NO. : 6,015,048
DATED : January 18, 2000
INVENTOR(S) : Satoshi Mitsumura et al.

It is certified that error appears in the above-identified patent and that said Letters Patent is hereby corrected as shown below:

Title page,
Item [76], Inventors,
"[76] Inventors: Satoshi Mitsumura; Yoshinori Tsuji. Both of c/o Canon Kabushiki Kaisha 30-2, 3-chome, Shimomaruko, Ohta-ku, Tokyo, Japan" should read
-- [75] Inventors: Satoshi Mitsumura; Yoshinori Tsuji, both of Yokohama, both of Japan --.

[*] Notice:
Insert -- [73] Assignee: Canon Kabushiki Kaisha, Tokyo, Japan --.

Item [57], ABSTRACT,
Line 9, "nozzle the" should read -- nozzle. The --.

Column 4,
Line 23, "gravity" should read -- gravities --;
Line 47, "curves" should read -- curve --.

Column 5,
Line 24, "course" should read -- coarse --.

Column 7,
Line 8, "a" should be deleted.

Column 8,
Line 25, "18" should read -- 18 are --.

UNITED STATES PATENT AND TRADEMARK OFFICE

CERTIFICATE OF CORRECTION

PATENT NO. : 6,015,048
DATED : January 18, 2000
INVENTOR(S) : Satoshi Mitsumura et al.

It is certified that error appears in the above-identified patent and that said Letters Patent is hereby corrected as shown below:

Column15,
Line 45, "for" should be deleted.

Column 18,
Line 38, delete "come";
Line 39, "take upper" should read -- take an upper --.

Signed and Sealed this

Twenty-fifth Day of December, 2001

*Attest:*

*Attesting Officer*

JAMES E. ROGAN
*Director of the United States Patent and Trademark Office*